United States Patent [19]

Shaer

[11] 4,243,546

[45] Jan. 6, 1981

[54] STABLE AQUEOUS COMPOSITIONS CONTAINING ENZYMES

[75] Inventor: Elias H. Shaer, Cincinnati, Ohio

[73] Assignee: The Drackett Company, Cincinnati, Ohio

[21] Appl. No.: 23,363

[22] Filed: Mar. 23, 1979

[51] Int. Cl.[3] ..... C11D 7/42; C11D 3/386

[52] U.S. Cl. ..... 252/174.12; 252/89.1; 252/DIG. 12; 252/110; 252/117; 252/534; 252/535; 252/539; 252/558

[58] Field of Search ..... 252/174.12, 89.1, DIG. 12, 252/110, 117, 558, 539, 535, 534

[56] References Cited

U.S. PATENT DOCUMENTS

| | | | |
|---|---|---|---|
| 3,630,929 | 12/1971 | van Dijk | 252/132 X |
| 3,650,965 | 3/1972 | Cantor | 252/142 X |
| 3,869,399 | 3/1975 | Collins | 252/117 X |
| 3,870,647 | 3/1976 | Travers | 252/122 X |
| 3,953,380 | 4/1976 | Sundby | 252/527 X |
| 4,142,999 | 3/1979 | Bloching et al. | 252/117 X |

*Primary Examiner*—Mayer Weinblatt

*Attorney, Agent, or Firm*—Sharon A. Blinkoff; George A. Mentis

[57] ABSTRACT

An aqueous detergent composition containing an enzyme which is stabilized with an alkanolamine and an organic or an inorganic acid.

19 Claims, No Drawings

STABLE AQUEOUS COMPOSITIONS CONTAINING ENZYMES

DESCRIPTION

BACKGROUND OF THE INVENTION

This invention relates to the long term stabilization of an enzyme contained in an aqueous composition by an alkanolamine and an organic or inorganic acid.

The desirability of using proteolytic and alpha amylolytic enzymes in cleaning compositions is well known. These enzymes are useful for their ability to reduce macromolecules such as proteins and starches into smaller molecules so that they can be readily washed away by detergents and/or water. Specifically, the proteolytic enzymes are useful in breaking down proteins and the alpha amylolytic enzymes are useful in breaking down carbohydrates. Detergent compositions containing these enzymes have a wide variety of uses in that they care capable of removing proteinaceous and starchy stains such as egg stains, blood stains, gravy stains and the like.

Detergent compositions containing enzymes have been commercially available in dry powdered form. However, there are inherent problems with these compositions. First, they must be stored in such a way as to be protected from humidity and high heat to insure enzyme stability. Second, these dry powdered compositions are not well suited for several useful applications such as spot cleaners, laundry pre-soaks and pre-spotters which require direct application to the stained surface. For these and other applications it is desirable to have an aqueous enzyme composition. Economic as well as processing considerations necessitate the use of water in liquid enzyme compositions. However, there is an inherent problem in adding an enzyme to an aqueous medium in that enzymes are rapidly denatured in water resulting in a loss of enzyme activity.

In order to have an aqueous enzyme composition which is suitable for the uses described above, the enzyme must be stabilized so that it can retain its activity for long periods of time.

Attempts have been made to stabilize enzymes contained in water based compositions.

U.S. Pat. No. 3,296,094 to Cayle utilizes a partially hydrolyzed and solubilized collagen, and glycerol to stabilize an aqueous proteolytic enzyme composition. The amount of glycerol required for stabilization in this composition is between 35% to 60% by weight of the total composition. The large quantities of glycerol required render this composition relatively expensive.

U.S. Pat. No. 3,557,002 to McCarty utilizes a monohydroxy alcohol or an alkoxy alcohol to stabilize a proteolytic enzyme. Although the amount of alcohol used in this composition is less than that used in Cayle the residual activity of the enzyme of this composition decreases after long periods of storage at relatively high temperatures.

It is an object of this invention to provide stabilized aqueous enzyme compositions which are capable of maintaining enzyme activity for long periods of time.

It is a further object of this invention to provide stable aqueous enzyme compositions by using small amounts of relatively inexpensive stabilizing agents.

SUMMARY OF THE INVENTION

The compositions of this invention solve the problems encountered in the prior art by using relatively small amounts of inexpensive stabilizing agents to stabilize the enzyme. Further, these compositions provide excellent long term enzyme stability. The compositions are comprised of an enzyme selected from the proteases or alpha amylases, an alkanolamine, an organic or inorganic acid, and a nonionic or anionic surfactant, or a mixture of the anionic and nonionic surfactants.

Compositions of the present invention are comprised of the following ingredients by weight:

(1) from about 1% to about 90% water;

(2) from about 0.01% to about 6.0% of an acid selected from the group consisting of organic and inorganic acids;

(3) from about 0.10% to about 25.0% of an alkanolamine;

(4) from about 0.006% to about 5.00% enzyme selected from the group consisting of proteases and alpha amylases; and (5) from 1% to 55% of a nonionic or anionic surfactant or a mixture of the nonionic and anionic surfactants.

DETAILED DESCRIPTION OF THE INVENTION

In accordance with the present invention, it has been found that by combining certain acids with an alkanolamine in the presence of a nonionic or anionic surfactant, or a mixture of the nonionic and anionic surfactants, a proteolytic or an alpha amylolytic enzyme can be stabilized in an aqueous medium. Further it has been found that the enzyme thus stabilized will retain its activity for a period of time in order to 18 months.

The main ingredients of this composition are water, enzyme, surfactant, an alkanolamine, and an organic or inorganic acid. Additional ingredients can be added to the compositions such as alcohol, sodium xylene sulfonate, and organic solvent such as the isoparaffinic mixtures of petroleum distillates. The addition of these will further enhance the stability of the enzyme. Further, the addition of the alcohol will act to lower the viscosity, where desirable.

Water comprises from about 1% to about 90% by weight of the total composition. The water present will vary depending upon the amount of surfactant and whether the other optional ingredients are added. The preferred amount of water is from about 40% to about 60% by weight.

The enzymes which are stabilized by and therefore suitable for use in the present invention are the proteases and the alpha amylases, which are commercially available.

The proteases which are derived from bacterial or fungal sources can be classified into three different categories: acidic, neutral, and alkaline proteases. These enzymes will be active in pH's ranging from about 3 to about 10. The proteases catalyze the hydrolysis of the peptide linkages of proteins, polypeptides and other related compounds. By breaking the peptide bonds of proteins, free amino and carboxy groups are formed which are short chain molecules that can easily be washed away by water and/or detergent. All three categories of proteases are useful in this invention, however, the alkaline proteases which are active in pH's ranging from about 7 to about 10 are preferred.

The alpha amylases are active in the acidic pH ranges. These enzymes catalyze reactions which break starch molecules into shorter chain molecules so that they can be washed away by detergent and/or water.

Compositions of this invention will stabilize from about 0.006% to about 5.0% by weight of an active enzyme. The amount of enzyme preferred for use is from about 0.6% to about 2.5% by weight.

The stabilizing system of this invention is comprised of an alkanolamine and an acid. There is a functional relationship between these stabilizing agents which requires, that within the ranges specified herein for alkanolamine and acid, the alkanolamine should be present in amounts which are 5–0.5 times the amount of acid present. The preferred ratio of alkanolamine to acid is 3.3 to 1.

The alkanolamines suitable for use can be selected from the group of alkanolamines having the formula:

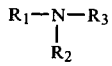

where $R_1$, $R_2$, and $R_3$ may be a hydroxy alkyl having from 1–6 carbon atoms or may be a hydrogen atom. There must always be one R which is a hydroxy alkyl.

The alkanolamines preferred are monoethanolamine diethanolamine, and triethanolamine. Triethanolamine is the most preferred. The alkanolamine used varies from about 0.1% to about 25.0% by weight. The preferred range is from about 1% to about 7% by weight.

The acids which form part of the stabilizing system of this composition are selected from the group consisting of organic or inorganic acids. The organic acids can be saturated or unsaturated, monoacids or diacids, containing up to eighteen carbon atoms. Any inorganic acid can be used with the exception of the hydrogen halides. The acid preferred for use in this invention is acetic acid. The amount of acid which can be used ranges from about 0.01% to about 6% by weight. The preferred amount ranges from 0.2% to about 1.5% by weight.

Any nonionic or anionic surfactant, or a mixture of the nonionic and anionic surfactants, can be used, in amounts ranging from about 1% to about 55% by weight. The amount preferred is between about 20% to about 40% by weight.

Examples of suitable nonionics include:

(1) Ethoxylated fatty alcohols—having the formula: $RO\text{-}(CH_2CH_2O)_nH$ where R is from 8 to 18 carbon atoms and n is an integer of from 1 to 500.

Examples of these are:

(a) the condensation product of 1 mole of an aliphatic alcohol, having from 12 to 13 carbon atoms in either a straight or branched chain configuration, with an average of 6.5 moles of ethylene oxide;

(b) the condensation product of 1 mole of an aliphatic alcohol, having from 12 to 15 carbon atoms in either a straight or branched chain configuration, with 9 moles of ethylene oxide; and (c) the condensation product of 1 mole of an aliphatic alcohol, having between 12 and 15 carbon atoms in either the straight or branched chain configuration, with 3 moles of ethylene oxide.

Examples of (a), (b) and (c) are commercially available under the trade names of Neodol, Neodol 23-6.5, Neodol 25-9, and Neodol 25-3 respectively.

(2) Ethoxylated fatty acids—having the formula:

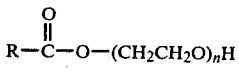

where R and n are as in (1).

(3) Ethoxylated alkyl phenols—having the formula:

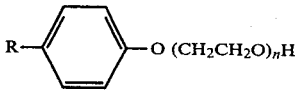

where R is an alkyl radical having from 6 to 16 carbons and n is an integer from 1 to 500.

Examples of suitable anionics include:

(1) Soaps—having the formula:

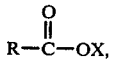

where x is sodium or potassium and R is a fatty acid radical either saturated or unsaturated having from 10 to 18 carbon atoms.

(2) Alkyl benzene sulfonates—having the formula:

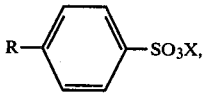

where X is ammonium, triethanol-ammonium, sodium or potassium and R is an alkyl radical having from 8 to 18 carbon atoms.

(3) Hydroxy alkane sulfonates—having the formula:

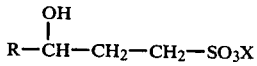

where X is as in (2) and R is an alkyl radical having from 10 to 15 carbon atoms.

(4) Sulfonated fatty acids—having the formula:

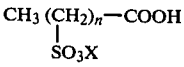

where X is as in (2) and n is an integer between 12 and 18.

(5) Sulfonated nonionics—having the formula:

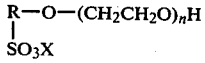

where X is as in (2) and n is an integer from 8 to 16.

(6) Fatty alcohol sulfates—having the formula: $CH_3(CH_2)_nCH_2O\text{-}SO_3X$ where X is as in (2) and n is an integer from 8 to 16.

(7) Sulfated nonionics—having the formula: $RO\text{-}(CH_2CH_2O)_n\ SO_3X$ where X is as in (2), R is an alkyl radical having from 12 to 18 carbon atoms and n is an integer from 1 to 50.

(8) Mono- and di-esters of sodium sulfosuccinates—having the formula:

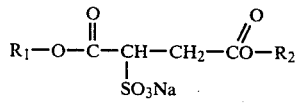

where $R_1$ is either sodium, hydrogen or an alkyl radical having from 1 to 12 carbon atoms. $R_2$ is an alkyl radical having from 1 to 12 carbon atoms.

The preferred surfactants are the nonionics formed from ethoxylated fatty alcohols, which are commercially available under the trade name Neodol.

Alcohol may be added to the composition of this invention to further increase the enzyme stability and to lower the viscosity. Suitable alcohols are those having the formula of ROH where R is an alkyl having from one to six carbon atoms, in either branched or straight chain configurations. Up to 25% by weight of alcohol can be used in the compositions. The preferred amount of alcohol is about 10% by weight and the preferred alcohol is ethanol.

Sodium xylene sulfonate and organic solvents such as isoparaffinic mixtures of petroleum distillates, may also be included in the compositions to further enhance the stability. Sodium xylene sulfonate can be added in amounts of up to 10% by weight, however 3% is preferred. The organic solvents may be added in amounts of up to 75% by weight with 10% being preferred.

The pH of these compositions will vary depending on the amount of alkanolamine and acid present. Within the useful range of ratios of alkanolamine to acid the pH of the compositions will vary from 6.5 to about 10.5. Since the enzymes suitable for use in these compositions exhibit activity in specific pH ranges, it may be necessary to adjust the pH for a given enzyme. This can be done by adding small amounts of a base such as sodium hydroxide or by adding small amounts of acid such as acetic acid. Given that the enzymes preferred for use are the neutral or slightly alkaline proteolytic enzymes, pH's with the range of 7–8.5 are preferred.

There are a variety of uses for the composition of this invention. For example, these compositions may be used as spot removers. They may also be used in home laundering operations as pre-soaks and as laundry additives for use during the wash cycle of an automatic washer.

The following examples illustrate the invention.

EXAMPLE 1

The following compositions were prepared and stored in closed-glass containers at 100° F. for the indicated time periods. It is estimated that one week storage at 100° F. is equivalent to 3 months storage at room temperature.

| Sample No. | 1(a) | 1(b) | 2 | 3 | 4 | 5 | 6 |
|---|---|---|---|---|---|---|---|
| pH | 7.4 | 7.5 | 7.3 | 7.5 | 7.5 | 9.5 | 7.2 |
| Ingredients | % Wt. | % Wt. | % Wt. | % Wt. | % Wt. | % Wt. | % Wt. |
| Neodol 25-9[1] | 15 | 15 | 15 | 18.25 | 16.05 | 15 | 15 |
| Neodol 23-6.5[2] | 15 | 15 | 15 | 18.25 | 16.05 | 15 | 15 |
| Triethanolamine | 5 | 2 | 0 | 0 | 0 | 5 | 0 |
| Acetic acid | 1.5 | .6 | 0 | 0 | 0 | 0 | 1.5 |
| Ethanol | 8.4 | 8.4 | 8.4 | 8.4 | 8.98 | 8.4 | 8.4 |
| Savinase[3] | 1 | 1 | 1 | 1 | 1 | 1 | 1 |
| Water, Perfume & Dye | q.s. 100% | q.s. 100% | q.s. 100% | q.s. 100% | q.s. 100% | q.s. 100% | q.s. 100% |
| % Initial Activity | 100 | 100 | 100 | 100 | 100 | 100 | 100 |
| % Act.After[4] 4 Weeks | 91 | 89 | 60 | 63 | 56 | 47 | 0 |
| % Act.After[4] 6 Weeks | 77 | 91 | 51 | 51 | 48 | 55 | 0 |

[1]Nonionic surfactant comprised of an ethoxylated alcohol where one mole of aliphatic alcohol having from 12 to 15 carbon atoms was ethoxylated with 9 moles of ethylene oxide.
[2]Nonionic surfactant comprised of an ethoxylated alcohol where one mole of aliphatic alcohol having from 12 to 13 carbon atoms was ethoxylated with 6.5 moles of ethylene oxide.
[3]A commercial alkaline proteolytic enzyme preparation available from Novo Industries containing 6% active enzymes with an activity of 8.0 Kilo Novo protease units.
[4]Percent remaining activity was determined by Tri-nitro-benzene sulfonate method using casein as a substrate. Activity values are subject to an experimental error of ±5%.

Review of this data shows that the enzyme will deactivate fairly rapidly when neither of the two stabilizing agents is present or when only one is present. Maximum stability is achieved when both stabilizing agents are present in a ratio of 3.3 parts alkanolamine to 1 part acid.

EXAMPLE 2

A composition was prepared comprising by weight percent of the total composition, approximately: 30% non-ionic surfactant[1]; 2% triethanolamine; 0.6% acetic acid; 9% ethanol; 10% of an isoparaffinic mixture of petroleum distillates having an average molecular weight of 154; 3% of sodium xylene sulfonate; 1% of Savinase, a commercial alkaline proteolytic enzyme preparation available from Novo Industries containing 6% active enzyme with an activity of 8.0 Kilo Novo protease units; and 54.5% water. This composition was placed in a glass container and stored at 100° F. for six weeks.

[1]This is a mixture of the Neodols (a), (b), and (c), described on page 7 where (a), (b), and (c) are present in the ratio of 2:1:1 respectively.

The activity of the enzyme was tested at 4 weeks and at 6 weeks using the Tri-nitrobenzene sulfonate method using casein as a substrate. The percent remaining activity at 4 weeks was 92%±5% (experimental error) and the percent remaining activity at 6 weeks was 96%±5% (experimental error). Comparing these results with the results in Example 1 shows that the addition of sodium xylene sulfonate and the isoparaffinic mixture to the compositions of this invention enhances enzyme stability.

EXAMPLE 3

The following 3 sample compositions were prepared and stored in glass containers for 2 weeks at 100° F.

| Ingredients | Sample No. 1 % wt. | 2 % wt. | 3 % wt. |
|---|---|---|---|
| Nonionic surfactant | 30 | 30 | 38.4 |
| Triethanolamine | 5 | 0 | 5 |
| Acetic acid | 1.5 | 0 | 1.5 |
| Ethanol | 8.4 | 8.4 | 0 |
| Savinase[1] | 1 | 1 | 1 |
| Water, perfume, dye | q.s. 100% | q.s. 100% | q.s. 100% |
| Activity[2] after 2 weeks | 89% | 65% | 71% |

[1]A commercial alkaline proteolytic enzyme preparation available from Novo Industries containing 6% active enzyme with an activity of 8.0 Kilo Novo protease units.
[2]Percent remaining activity determined by Tri-nitro-benzene sulfonate method using casein as a substrate. Activity values subject to experimental error of ± 5%.

Review of the above data shows that the composition containing the two stabilizing agents, triethanolamine and acetic acid, and no alcohol has better stability than the composition containing just alcohol. The above data shows that adding ethanol to the composition containing triethanolamine and acetic acid will enhance the stabilizing effect of the triethanolamine and the acetic acid. Although the ethanol has a stabilizing effect, it is not as effective a stabilizer as the combination of triethanolamine and acetic acid and is not the primary stabilizing agent of this invention.

All compositions were made by adding together each of the ingredients.

Having described some typical embodiments of this invention it is not my intent to be limited to the specific details set forth herein. Rather, I wish to reserve to myself any variations or modifications that may appear to those skilled in the art and fall within the scope of the following claims.

I claim:

1. A stabilizing aqueous enzyme composition consisting essentially of:

(1) from about 1% to about 90% by weight of water;

(2) from about 0.01% to about 6% by weight of an acid selected from the group consisting of saturated or unsaturated organic monoacids and diacids having from 1 to 18 carbon atoms;

(3) from 0.1% to about 25% by weight of an alkanolamine selected from the group consisting of monoethanolamine, diethanolamine and triethanolamine;

(4) from about 0.006% to about 5.0% by weight of an enzyme selected from the group consisting of proteases and alpha amylases; and (5) from about 1% to about 55% by weight of a surfactant selected from the group consisting of nonionic surfactants, anionic surfactants, and mixtures of nonionic and anionic surfactants.

2. A stabilizing aqueous enzyme composition consisting of:

(1) from about 1% to about 90% by weight of water;

(2) from about 0.01% to about 6% by weight of acetic acid;

(3) from about 0.1% to about 25% by weight of an alkanolamine selected from the group consisting of monoethanolamine, diethanolamine, and triethanolamine;

(4) from about 0.006% to about 5.0% by weight of an enzyme selected from the group consisting of proteases and alpha amylases; and (5) from about 1% to about 55% by weight of a surfactant selected from the group consisting of nonionic surfactants anionic surfactants, and mixtures of nonionic and anionic surfactants.

3. The composition of claim 2 wherein the pH is from about 6.5 to about 10.5.

4. The composition of claim 2 wherein the pH is from about 7 and to about 8.5.

5. The composition of claim 4 wherein the percent by weight of water is from about 40% to about 60%.

6. The composition of claim 5 wherein the percent by weight of the enzyme is from about 0.6% to about 2.5%.

7. The composition of claim 6 wherein the percent by weight of the surfactant is from about 20% to about 40%.

8. The composition of claim 7 wherein the enzymes are alkaline proteases.

9. The composition of claim 8 wherein the alkanolamine is triethanolamine.

10. The composition of claim 9 containing by weight from about 1% to about 25% of an alcohol selected from the group consisting of alcohols having the formula ROH wherein R is an alkyl of from one to six carbon atoms.

11. The composition of claim 10 wherein the percent by weight of the alcohol is about 10%.

12. The composition of claim 11 wherein the alcohol is ethanol.

13. The composition of claim 12 wherein the percent by weight of the triethanolamine is about 2%; and wherein the percent by weight of the acetic acid is about 0.6%.

14. The composition of claim 13 wherein the surfactant is an ethoxylated fatty alcohol having the formula: $RO—(CH_2CH_2O)_nH$ where R is from 8 to 18 carbon atoms and n is an integer from 1 to 500.

15. The composition of claim 12 wherein the percent by weight of the triethanolamine is about 5%; and wherein the percent by weight of the acetic acid is about 1.5%.

16. The composition of claim 15 wherein the surfactant is an ethoxylated fatty alcohol having the formula: $RO—(CH_2CH_2O)_nH$ where R is from 8 to 18 carbon atoms and n is an integer from 1 to 500.

17. The composition of claims 13 or 15 containing by weight of the composition:

(1) from about 1% to about 10% sodium xylene sulfonate; and (2) from about 1% to about 75% of an isoparaffinic mixture of petroleum distallates having an average molecular weight of about 154.

18. The composition of claim 17 wherein the sodium xylene sulfonate is about 3% by weight of the total composition; and wherein the isoparaffinic mixture of petroleum distillates is about 10% by weight of the total composition.

19. The composition of claim 18 wherein the nonionic surfactant is a mixture of:

(1) The condensation product of 1 mole of an hydrocarbon alcohol having from 12 to 13 carbon atoms in either a straight or branched chain configuration with an average of 6.5 moles of ethylene oxide;

(2) the condensation product of 1 moles of an hydrocarbon alcohol, having from 12 to 15 carbon atoms in either a straight or branched chain configuration, with 9 moles of ethylene oxide; and (3) the condensation product of 1 mole of an hydrocarbon alcohol, having between 12 and 15 carbon atoms in either the straight or branched chain configuration, with 3 moles of ethylene oxide.

* * * * *